US006941883B2

(12) United States Patent
Nguyen

(10) Patent No.: US 6,941,883 B2
(45) Date of Patent: Sep. 13, 2005

(54) SUBMERGED UNDERWATER OBSERVATION BOOTH

(76) Inventor: Luong Dang Nguyen, 42 St., Block 3, Tan Quy Ward, 7th District, Ho Chi Minh City (VN)

( * ) Notice: Subject to any disclaimer, the term of this patent is extended or adjusted under 35 U.S.C. 154(b) by 0 days.

(21) Appl. No.: 10/969,609

(22) Filed: Oct. 21, 2004

(65) Prior Publication Data

US 2005/0109254 A1 May 26, 2005

(30) Foreign Application Priority Data

Oct. 29, 2003 (VN) ..... 1-2003-00970

(51) Int. Cl.[7] ..... B63B 35/00
(52) U.S. Cl. ..... 114/66; 114/334
(58) Field of Search ..... 114/66, 314, 326, 114/327, 328, 330, 334, 335, 339; 405/192; 441/1, 21, 28

(56) References Cited

U.S. PATENT DOCUMENTS 3,527,184 A * 9/1970 McCarty et al. ..... 114/331
3,613,621 A * 10/1971 McKinley et al. ..... 114/66
3,996,870 A * 12/1976 Haavie ..... 114/66
4,109,601 A * 8/1978 Ronnevig ..... 405/190
4,276,851 A * 7/1981 Coleman ..... 114/313
5,067,427 A * 11/1991 Kobayashi ..... 114/61.3
5,117,774 A * 6/1992 English et al. ..... 114/66
6,612,251 B1 * 9/2003 Ness ..... 114/66

* cited by examiner

*Primary Examiner*—Stephen Avila

(57) ABSTRACT

The invention concerns the structure of a "SUBMERGED UNDERWATER OBSERVATION BOOTH", including a floating station on water surface, and a piping system to convey fresh air and power into the SUBMERGED BOOTH. The SUBMERGED BOOTH provides an atmospheric environment with all the necessary equipment and facilities to a person doing underwater observation or research. The SUBMERGED BOOTH can travel underwater in both vertical and horizontal directions. The SUBMERGED BOOTH is designed either in the shape of a cylinder with two half-spheres at both ends, or in the shape of a sphere, with clear plastic wall all around, to provide the observer with maximum viewing angle. The invention aims to provide a system for a wide application area and many purposes of use under water such as: exploration, tourist, research, maintenance, repair, etc. . . .

18 Claims, 7 Drawing Sheets

SUBMERGED UNDERWATER OBSERVATION BOOTH

TECHNICAL FIELD

The invention mentions about the design and manufacture of an assembled module-form SUBMERGED UNDERWATER OBSERVATION BOOTH, to provide a popular means, suitable to all users, for many purposes of use, to address the needs of research, inspection, evaluation, and study of the landscapes and conditions of marine projects, and aquatic resources. Tourists visiting ocean sites, of any physical condition, can go explore the ecological underwater at reasonable depths, with the ability to decide on the location and the duration of the observation without any restriction, thanks to the navigation and control of equipment, as well as on-board appliances such as head lights, communication devices, and etc. . . .

The observer is not directly exposed to pressure of deep water, and is able to breathe fresh air at atmospheric pressure directly from sea level.

BACKGROUND OF THE INVENTION

In response to the needs such as: of organized tourism to visit the ecology, or of specialists who need to inspect, study and evaluate marine projects, waterways and basins, at a depth of from few to some tens of meters below water level, current solutions and means being offered are still as follows:

Use of personal diving equipment including diving suits and air compressor. These types of equipment present the following problems: the participant has to be trained, invest time into learning, and meet some physical condition requirements that not everyone can. The duration of observation is limited. And, the deeper below water level, the weaker light intensity becomes. Some components of the light spectrum, such as red, yellow, and their composites, will be greatly reduced, causing color distortion. Therefore, as we move deeper into water, colors from the landscape are reduced to monotony, and the scenery will appear surreal as it loses its vivacity.

Exploring cruise boats where tourists can look through the transparent bottom to see below water level. This approach is simple and popular, however it does have some problems: restriction to the angle and direction of observation; in deep water, light intensity decreases, and, due the large distance between the boat and the observed landscape below, vision becomes blurred and details cannot be revealed as wished.

Tunnels of transparent material sitting at the bottom of the sea. Tourists can move around inside such tunnels. This method is also simple and popular, but provides no of choice of location, direction or object for observation.

"Diving bells" and "diving boxes", operating solely on the principle of submarines, are used for scientific researches. They can go down hundreds of meters underwater and use stored compressed air for breathing. These methods still have limited applications because of physical condition requirements and are difficult to implement.

At the bottom of the "Calypso", a marine research vessel of Jacques Yves Cousteau (a French oceanographer), is a large pipe of glass, at 2.6 meters below sea-level, for the observer to go inside, survey and record pictures of the aquatic biosphere. This type of vessel is unique in the world and has stopped operation.

Therefore the purpose of invention is to propose the design and manufacture of an assembled module, accessible to every users, for different purposes and applications such as: going down into fairly deep water for observation, survey, research, evaluation, video recording etc . . . of the aquatic world, the ecological environment; or inspection of underwater projects, bridge columns, bridgeheads; or research of water basins, discovery of obstacles at bottom of waterways; tracking or discovering sea-fish current, etc. . . . There is no requirement on physical condition of the observer, and there is no time limit on the length of observation. The invention consists of a system to include: a set of floating buoys connected at the bottom to a transparent submersible booth lodging an observer with all supportive equipment. Connecting the submerged booth to the buoys set is a piping system for the supply of breathing air and the delivery of power via electric cables into the booth. The booth is equipped with automated proximity detection devices to adjust to the topography of the waterbed, to avoid collision, and to protect the ecology. Since the observer being completely isolated, no harm can be done to the underwater landscape, environment and biosphere.

SUMMARY OF THE INVENTION

The aim of the invention is to propose the design and manufacture of an assembled module of UNDERWATER OBSERVATION BOOTH, capable of addressing the needs of many people, and the challenge of many applications. Observation is possible even in water basins of a few meters to tens of meters deep, with all the necessary and desired facilities and equipment, for an unlimited duration.

The aims, advantages and novelties of this invention will be presented in the detailed description and the principle of operation with attached drawings. To attain the objectives mentioned above, the basic structure of an assembled modular SUBMERGED UNDERWATER OBSERVATION BOOTH should consist of:

A. A set of buoys floating on water surface.

B. An underwater booth lodging an observer, designed in one of two following styles:

A kind of submerged booth moving up and down by push-pull force generated by a metallic piping system.

A kind of a booth being self submerging-floating, using adjusted weight and Archimedes lifting force.

C. A Structure connecting the submerged booth with the set of floating buoys consists of a piping system with essentially function to bring breathing air into, and out of, the submerged booth. This connecting piping system can be designed using one of two following approaches:

i) A set of metallic tubes parts fitting into one another, in a telescopic arrangement, to glide inside one another, in order to be stretched or retracted in length.

ii) A line of flexible plastic hose capable of being deployed or rolled back.

The inside such two piping system is used for breathing air exchange and to bring power via electric cable into the booth for proper operation.

While the observer navigates the submerged booth in the horizontal direction, the booth adjusts itself in the vertical direction by going up and down, to maintain the proper distance between the submerged booth and the depth of the site, thus avoiding any possible collision.

BRIEF DESCRIPTION OF DRAWINGS

- #1. (FIGS. 1A and 1B) Buoy set: a big single buoy or a number of small buoys being assembled into a set.
- #2. A piping system conducting air being designed in one of two following aspects:
  - i) (FIG. 1A): Metallic tubes which fit inside of one another and glide inside one another, allowing the piping system to be extended or shortened, or
  - ii) (FIG. 1B): Flexible plastic hose system that can be deployed or rolled back, as required by the navigating depth for submerged booth designed as submersible.
- #3. (FIGS. 1A and 1B): Submerged booth lodging the observer, built in a cylindrical shape with 2 half-spheres at both ends, or in a spherical shape, with transparent wall. At the base of the booth is the ballast. This booth can be designed under one of two following styles:
  - a) (FIG. 1A) Booth operating in vertical direction by push-pull force: such booth is connected to the buoy set (#1) through the telescopic assembly of gliding metal pipes (#2 i), or
  - b) (FIG. 1B) Submersible-style booth operating on Archimedes principle: This design incorporates an intermediate compartment to containing a regulated volume of water between the 2 clear walls. This type of booth is linked to the floating buoy set (#1) by flexible plastic piping (#2 ii).
- #4. (FIGS. 1A and 1B) Weight blocks made with high density metal.
- #5. (FIG. 1B) Lid to enter and exit the submersible-style booth.
- #6. (FIG. 1B) Capstan roll for flexible hose system on buoy set.
- #7. (FIG. 1B) Quick inflating buoy for fast return to surface.

- #2. (FIG. 2A) Metallic pipes air conduction and for introducing electric cables into the booth.
- #2. (FIG. 2B): Flexible plastic hose for air conduction, and for introducing electric cables into the booth.
- #3. (FIGS. 2A and 2B): The submerged booth lodging the observer and control equipment.
- #4. (FIGS. 2A and 2B): Weight blocks made with high-density metal.
- #5. (FIG. 2B): Opening-closing lid of submersible-style booth.
- #8. (FIG. 2B): Intermediate compartment using the regulated volume of water to control the booth weight.
- #9. (FIG. 2B): Pump regulating water volume in the intermediate compartment.

- #2A. (FIG. 3A): Metallic pipes, fitting inside of one another, sliding inside one another, acting as a duct for air and electric cables, while controlling the depth of submerged booth.
- #2*a*. (FIG. 3A): Rubber joints preventing water leakage into the submerged booth.
- #3. (FIG. 3A): Joint area between submerged booth wall and bottom-end of the innermost gliding pipe.
- #2B. (FIG. 3B): flexible plastic hose conducting air for ventilation and introducing electric cables.
- #2*b*. (FIG. 3B only): spring-shape coil lining the inner wall of the flexible hose to reinforce the piping structure, preventing the hose from kink or deformation under bending force.
- #4. (FIG. 3B only): Rings of weight blocks made from high-density metal around the flexible hose to counteract the Archimedes buoyant force when the hose submerges.

- #1. Buoy set floating on water surface.
- #2. Piping system for bringing air and electric cables into the booth for operation (system can be either a set of metallic pipes in a telescopic arrangement or a flexible plastic hose with metal reinforcement inside).
- #3. Cabin lodging an observer, with supportive equipment and facilities.
- #4. Block of heavy metal for weight increase.
- #10. Ultrasonic sensors for proximity detection.
- #11. Light-pole and light to warn vessels in the vicinity.
- #12. Cover roof to protect buoy platform and on board equipment.

DETAILED DESCRIPTION OF THE INVENTION

On the basis of the drawings described in the summary above, below are the details and explanation of principle of operation and design of an assembled modular SUBMERGED UNDERWATER OBSERVATION BOOTH of the invention.

Figure 1A:
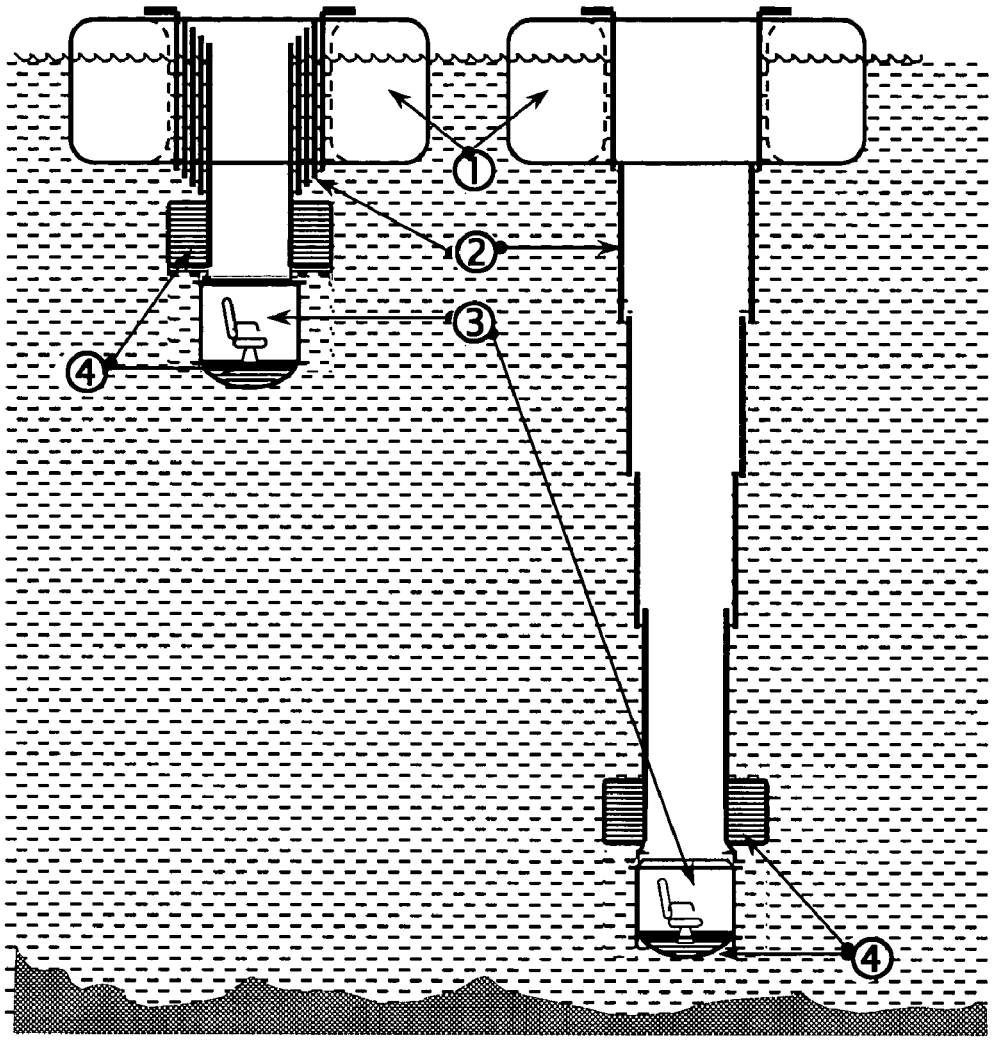
FIGS. 1A and 1B: Perspective view, description of structure, and principles of operation of the assembled modular UNDERWATER OBSERVATION BOOTH.
Figure 1B:
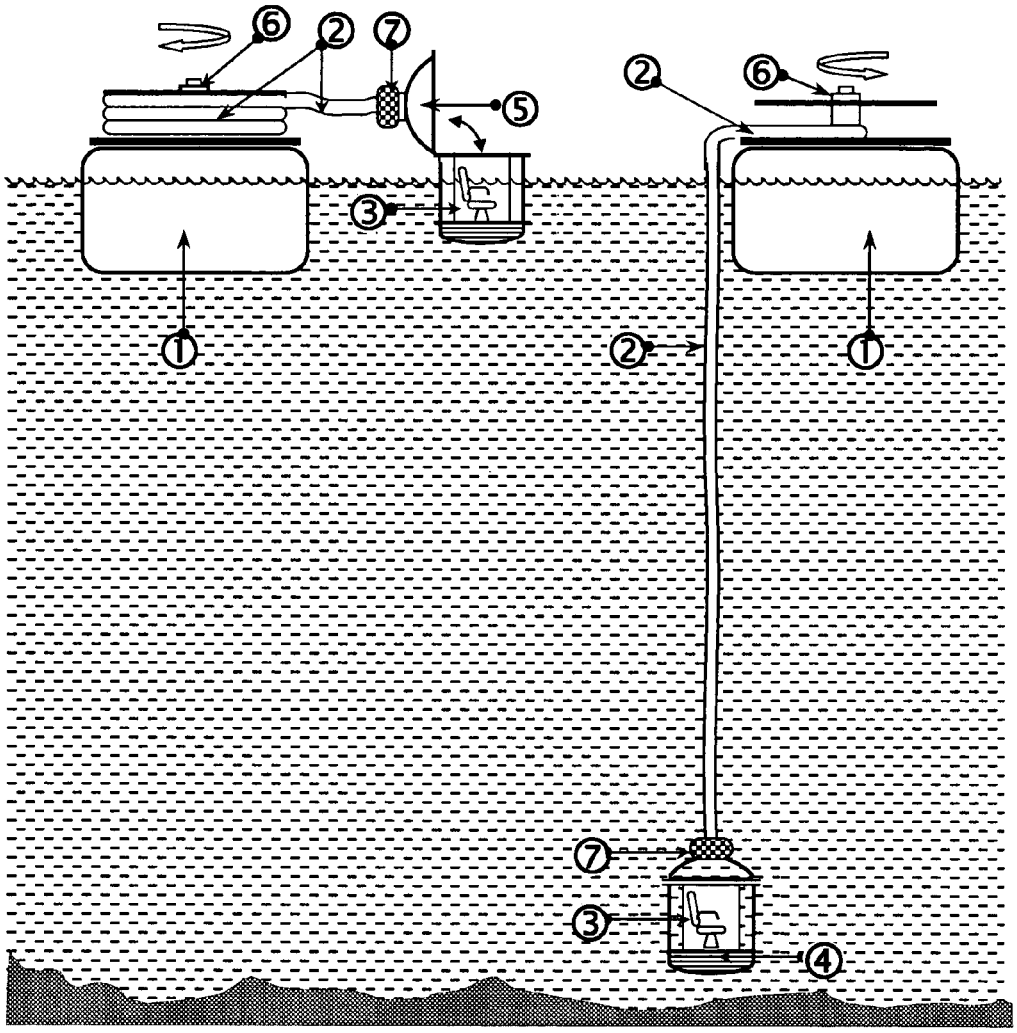

FIGS. 1A and 1B: description of structure and principle of operation of the assembled modular UNDERWATER OBSERVATION BOOTH of the invention includes:

- #1. (FIGS. 1A and 1B) Buoy system: possibly a single ring of floating Buoy or a quantity of small buoys assembled uniformly into a set with sufficient lifting force; strong enough to stand up against the wind and waves and stable enough to maintain the full assembled module in balance state at anytime. Also, it is the place of light-poles and lights to warn vessels in the vicinity and it is also the platform to install operational and supportive equipment of the system such as: power generator, life-saving devices, communicating stations etc. . . .
- #2. Air conduction piping system, possibly designed in one of two following styles:
  - i) #2. (FIG. 1A) Metallic pipes in a telescopic arrangement, capable of resisting water pressure and the submerged booth weight. They are held against each other with flexible joints acting as seals to prevent water leaks. These pipes fit inside of one another and glide inside one another to extend or shorten by hydraulic mechanism, or by cogwheels powered by an electric motor. The number of pipes and their length will depend on designs calculation, enabling the submerged booth to reach the required depth. The inner diameter of the pipes will be large enough to allow the observer to enter and exit the booth, to ensure proper air supply for breathing, and to provide power delivery via electric cables for into the submerged booth for its operation. Exhaled air from breathing will be pumped out from the floor of the observation booth by means of a flexible pipe, which also runs through the metallic pipes.

ii) #2. (FIG. 1B) Flexible plastic piping with sufficient strength to resist water pressure, being able to extend or retract on the roller (#6) to adjust to the depth of the submersible-style booth as this one travels in a vertical motion. The space inside such flexible piping should be large enough to allow air conduction and exchange, and to run electric cables through it for the operation of the submerged booth. Again, exhaled air from breathing is pumped out of the booth from the floor by means of a smaller flexible pipe, which also runs inside the larger flexible pipe.

Both types of piping system, whether rigid (as in FIG. 1A) or flexible (as in FIG. 1B), can be made heavier with weight blocks (#4) for better submersion and water displacement. Such weight increase must be enough to overcome or cancel Archimedes lifting forces from water displacement. With proper calculation, an equilibrium condition can be attained when the weight of the submerged section equals the Archimedes forces. Under such condition, a "weightless state" conveniently promotes balance and stability of the observation booth and of the whole system.

#3. (FIGS. 1A and 1B) The observation booth can be designed in a cylindrical shape with 2 half-spheres at both ends (FIG. 1A), or in a full spherical shape (FIG. 1B), made from in transparent Plexiglas with enough thickness to sustain pressure in deep water. Additional weight blocks (#4) to maintain stability of the submerged booth and to reduce or cancel Archimedes lifting force. One end of the hose for pumping out exhaled air is installed on the floor of the observation booth, and the exhaust hose system runs through the inside the larger piping system (#2). The inside the observation booth is equipped with amenities, control devices, depth meter, positioning devices, head light, wireless communication, etc. . . . The observation booth can be designed into one of two following types:

a) #3. (FIG. 1A) Booth operating in the vertical direction by push-pull force is linked with the buoy set is an assemblage of metallic pipes (#2) fitted into one another. Powered with hydraulic mechanism or cogs wheel, such portions of pipes will glide inside one another under push-pull forces to shorten or extend the length of the piping system. The result is the rising or lowering of the submerged observation booth in the vertical direction, to adjust to the depth of waterbed, in order to maintain the optimum distance for a better observation while preventing any collision between booth and waterbed.

b) #3 (FIG. 1B) Booth operating in the vertical direction by gravity-buoyancy force incorporates an extra compartment between the two transparent walls containing water for weight regulation. The booth is linked with the buoy system by a flexible hose (#2) coiled in the roller (#6) installed on the buoy set; such coiling allows the flexible hose system to expand or reduce its length in the vertical direction to meet the depth requirement as this type of self submerging-floating booth moves around.

#4. (FIGS. 1A and 1B) Additional weight blocks made of high-density metal are to increase the weight in order to reduce or cancel all Archimedes lifting forces that would act on the submerged booth (#3) and the piping system (#2).

#5. (FIG. 1B) Lid that can be opened and closed to allow the observer to going in and out of the style of the submersible-style booth that operates based on the principle of Archimedes lifting force.

#6. (FIG. 1B) Roller of flexible hose system being placed on top of the buoy set.

#7. (FIG. 1B) Donut-shape pneumatic buoy, in folded and deflated state, to be deployed and inflated quickly when the booth needs to return to surface fast in case of emergency.

Figure 2A:
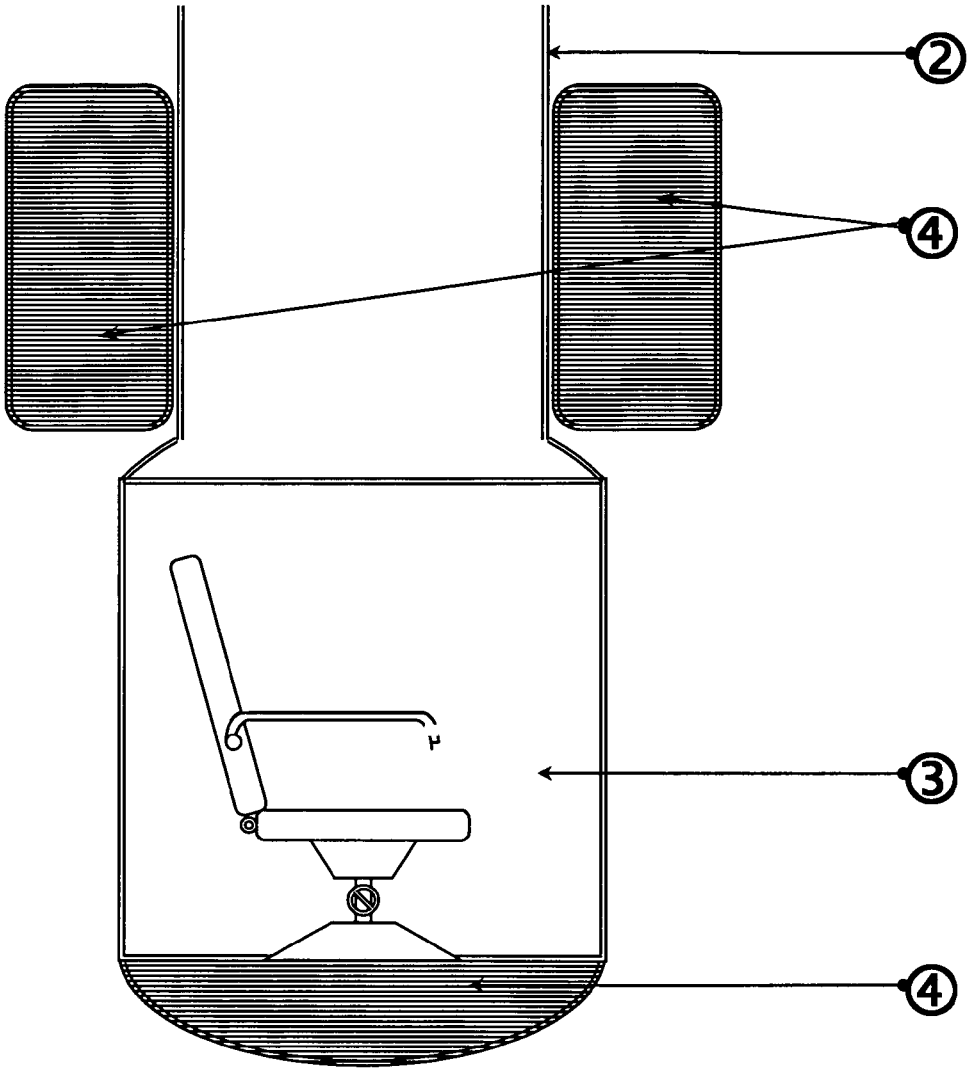
FIGS. 2A and 2B: Design structure of the 2 styles of submerged booth.
Figure 2B:
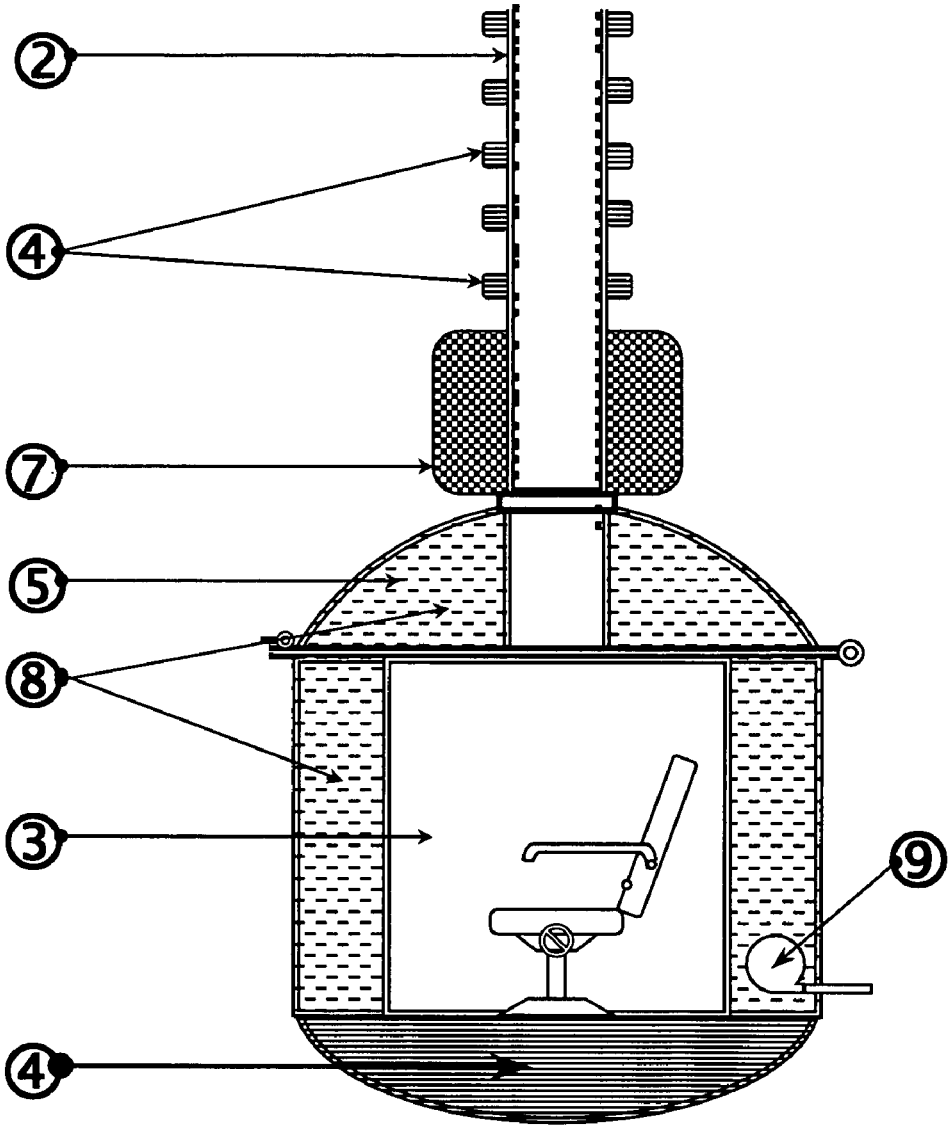

FIGS. 2A and 2B: Descriptions of structure and principle of operation of the two styles of submerged booth.

#2. (FIG. 2A) Portion of the innermost metallic pipe as part of the whole metallic piping system with all the pipes in a telescopic arrangement; this is the path-way for breathing air conduction and exchange, and for electric cables to reach the submerged booth; used with the style of booth which operates on the push-pull force.

#2. (FIG. 2B) Flexible hose system capable of supporting water pressure; the means for bringing air in and out of the submerged booth; the path-way for bringing electric cables into the submerged booth for operation; used with the style of booth that operates on the principle of weight-adjusting to submerge or float; such flexible hose system carries additional weight rings at specified distance to create balance with Archimedes lifting force once the hose system is submerged and water is displaced.

#3. (FIGS. 2A and 2B) Cabin for observation and control.

#4. (FIGS. 2A and 2B) Weight blocks of high-density metal to reduce or cancel Archimedes lifting force from water displacement as the booth submerges.

#5. (FIG. 2B) Lid which can open and close to allow the observer to enter and leave the booth.

#8. (FIG. 2B) Intermediate compartment designed to hold water between two clear walls. The volume of water in this compartment is used for increasing or decreasing the weight of the booth, and is controlled by a pump (#9). This type of submerged observation booth can adjust its own weight to submerge or float.

#9. (FIG. 2B) Pump to regulate the volume of water into, or out of, the intermediary compartment (#8), thus enabling the observation booth to submerge or float.

Figure 3A:
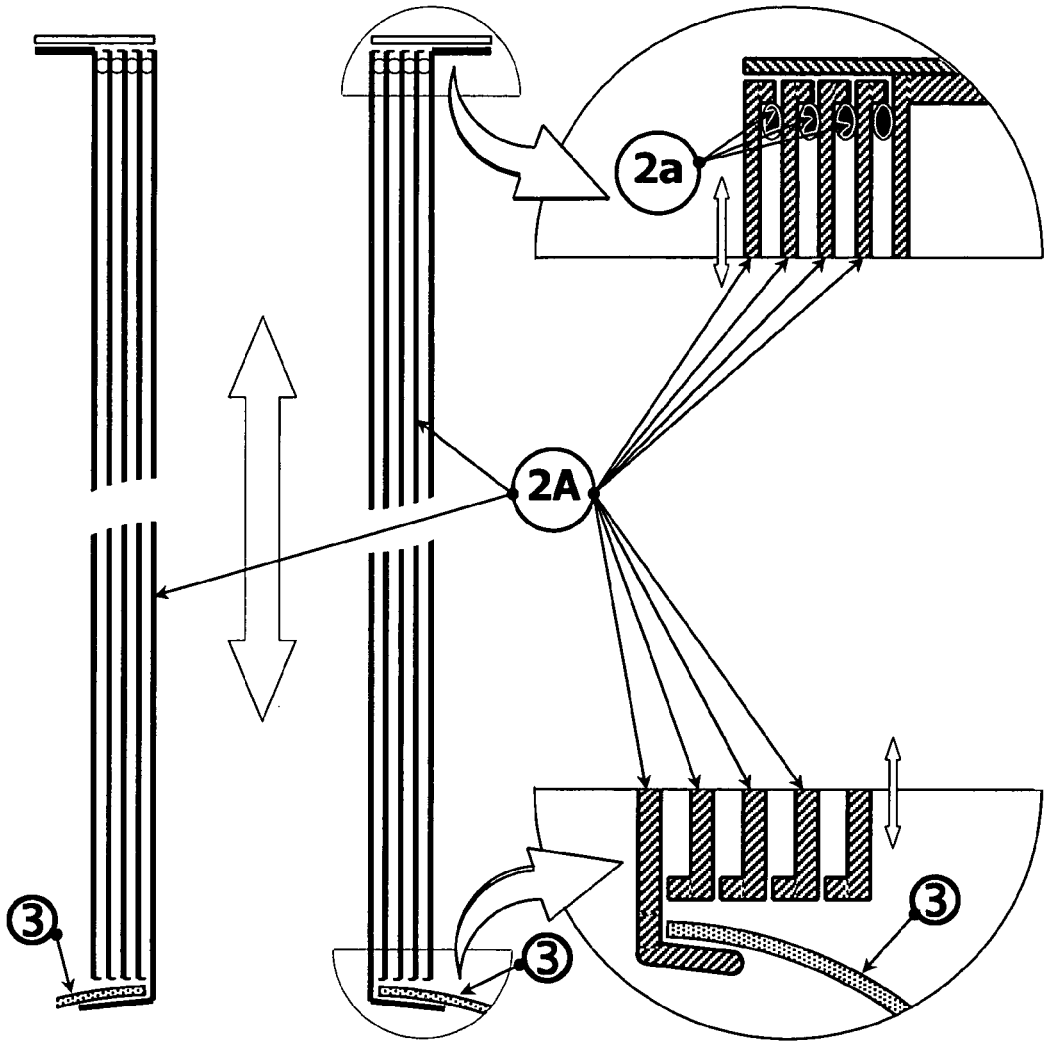
FIGS. 3A and 3B: Description of the two kinds of air-pipe structures: Rigid telescopic-shape piping (FIG. 3A) and flexible hose-style piping (FIG. 3B), for bringing air and electrical power into the submerged booth.

FIGS. 3A an 3B: Description of structure of the two styles of piping system, for supplying and exhausting breathing air, and for running operational electric cables into the observation booth.

#2A. (FIG. 3A) Portions of metallic piping system used for supplying and exhausting breathing air, and for running operational electric cables into the observation booth; this is also the push-pull mechanism that moves the observation booth up and down the vertical direction, to meet the required navigating depth.

#2*a*. (FIG. 3A) Sealing rubber rings to prevent water from leaking into the piping system and the observation booth.

#3. (FIG. 3A) Area where the wall of the observation booth is joined to the inner most tube of the metallic piping system.

Figure 3B:
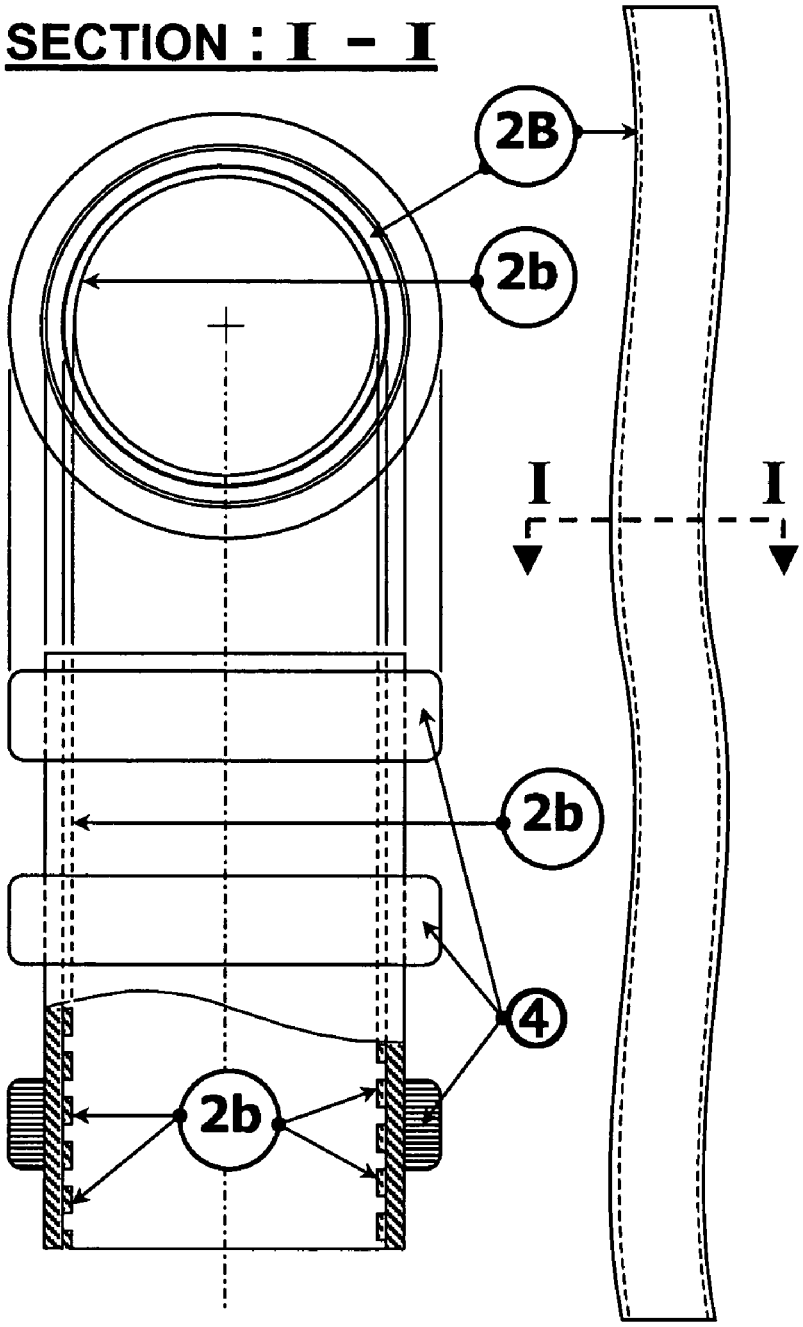

#2B. (FIG. 3B) Flexible plastic hose, reinforced on the inside, capable to standup to water pressure. The inner section of the hose should be large enough to house other items such as a flexible-hose for exhausting exhaled air, and for operational electric cables running into the booth, while providing enough spare room for fresh air column flowing from water surface into the booth.

#2*b* (FIG. 3B) Spring-shape rings are inserted along inner wall of flexible plastic hose to act as reinforcement against pressure, to maintain the roundness shape of the hose, and to prevent kinks and deformations when the hose is bent or rolled back.

#4. (FIG. 3B) Weight rings of high-density metal mounted on the outside of the hose, at pre-defined locations to create enough counterweight to balance Archimedes lifting force as the flexible hose are submerged and water is displaced.

Figure 4:
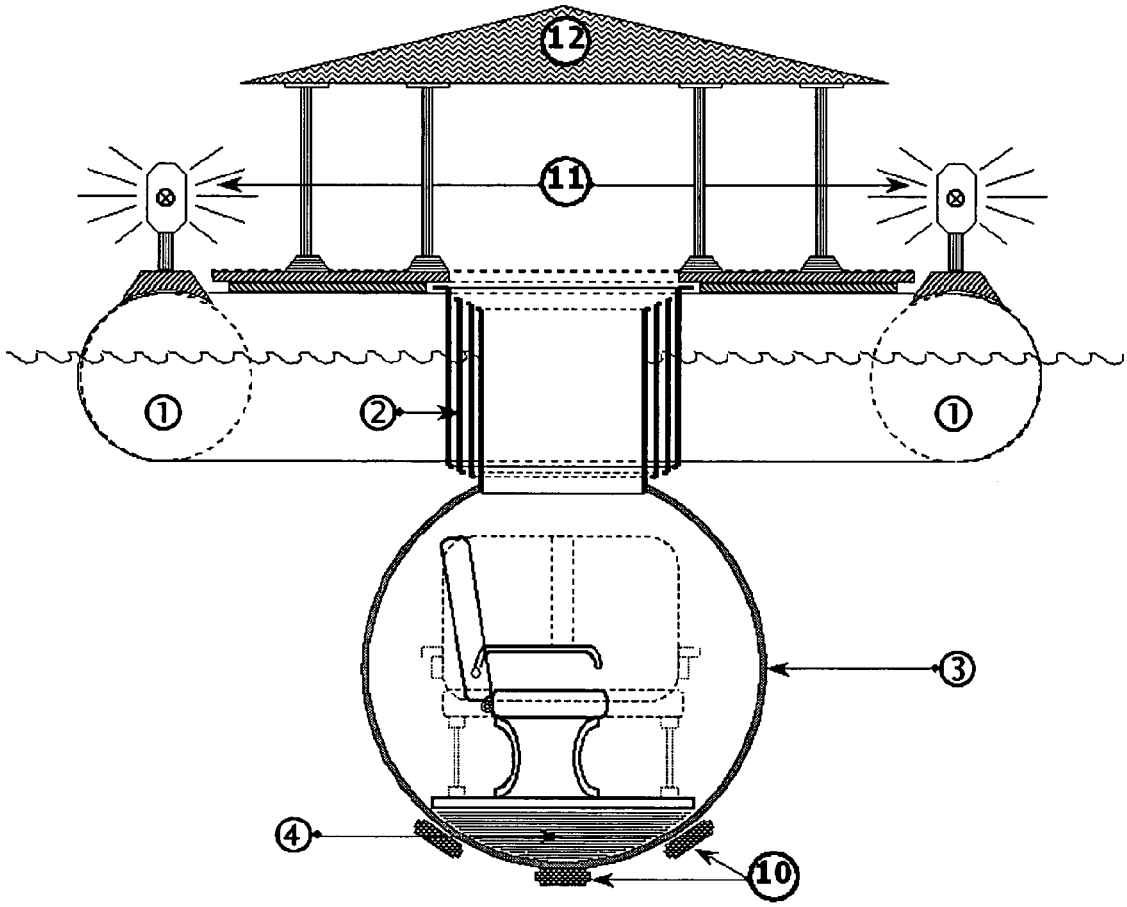
FIG. 4: description of general structure of an assembled modular UNDERWATER OBSERVATION BOOTH in operation.

FIG. 4: Description of general structure of an assembled modular SUBMERGED UNDERWATER OBSERVATION BOOTH when in operation:

#1: Set of buoys floating on water surface (with functional purposes as mentioned above).

#2: Piping system for conduction and exchange of breathing air inside the booth. If flexible hose is to be used, its cross-section should be large enough to house items such as another hose line for pumping out exhaled air, electric cables for the booth operation, and enough spare room for fresh air to flow in from above the observation booth. If metallic piping system is to be used instead, the cross-section should be even much larger, because the observer uses this same piping system to enter and leave the booth.

#3: Booth lodging the observer with all equipment and appliances, for navigation and control.

#4: Metallic blocks for weight increase.

#10: Ultrasonic proximity sensors in automatic mode to continuously monitor and keep the distance between the observation booth and the landscape, or objects at the bottom of the waterbed, to a preset value, for optimal close-up observations without the risk of collision. Using the preset distance, these ultrasonic sensors work in conjunction to automatically regulate and directly control the navigating and operating mechanisms below:

a. With a design using an assemblage of telescopic metallic pipes that glide inside another, they are the push-pull beams powered by hydraulic, or cogwheels powered by electric motors.

b. With a design using flexible plastic hose system linking the submerged underwater observation booth to the set of buoys, they are the water pumps for weight regulation (#9 in FIG. 2B).

#11: Posts and the warning lights for other vessels in the vicinity.

#12: Roof to cover and protect the module from the rain and direct sunrays. It is also the place to setup and install operational and supportive equipment such as: power generator; backup battery; exhaust fan to bring out the exhaled air from the booth floor; blowing fan to move fresh air into the underwater booth; climbing ladder to help the observer entering or exiting the booth; life-saver, hazard-prevention and communication devices. The cover roof can also be built from plates of solar cells to contribute energy to the module operation.

The underwater booth motion in the horizontal direction is controlled by the observer with either a "propeller" run by an electric motor or by a pressure water pump, located inside the weight block (#4) at the bottom of the underwater observation booth. For example: as the source of propulsion, the "propeller" can be rotated 360° to move the booth in the direction of choice and at the same time to control the speed of navigation; instead of the "propeller", a submersible pump that can create propelling water jets, with a nozzle that can rotate a full 360°, will have the same function of the "propeller" in choosing the direction and controlling the speed of navigation of the underwater observation booth.

In summary, the assembled modular SUBMERGED UNDERWATER OBSERVATION BOOTH mentioned in the invention can have wide application in a multitude of different fields, with no limit imposed on the time and duration of the observation sessions, and no limit on the physical condition of the participants to the observation trip. With a larger size underwater booth, more equipment can be installed or carried on board, to be used as helping tools for observation, research and recording: head lights; remote control of Robots diving outside the observation booth; portable scientific instruments, video recorder, etc. . . . With the advanced progress in material sciences and automation at present, the design—manufacture of the modular SUBMERGED UNDERWATER OBSERVATION BOOTH described in this invention is fully feasible.

What is claimed is:

1. An assembled underwater module for an observer, wherein said observer is not under water pressure and able to breathe directly atmospheric air being introduced into, and removed out of, the submerged booth, by means of air conducting pipes;

said assembled underwater module comprising:

a floating buoy set with sufficient buoyant force to keep module stable and in equilibrium state under water;

said floating buoy set being a station for introducing breathing air into said submerged booth and also a platform for operational and supportive devices including power generator, safety devices and communication systems;

a piping system for supplying breathing air and running electrical cables to said submerged booth with said observer inside;

weight blocks made with high density metal for additional weight;

a submerged observation booth for lodging said observer, operating equipment for said booth and said weight blocks;

ultrasonic sensors for proximity measurement and adjustment of distance of said submerged booth in vertical direction from waterbed floor;

a booth-lid that can open and close for the observer to enter and exit the booth;

light-poles and warning lights located on said floating buoy set for vessels in the vicinity;

a roof to cover the buoy set platform and the equipment on board;

wherein, said submerged booth wall being transparent for said observer to look through said submerged booth for a full 360° viewing angle;

said submerged booth being in either a cylindrical shape with two half-spheres at both ends, or a spherical shape; and said floating buoy set, said piping system, said ultrasonic sensors and said submerged booth are designed for synchronous operation and coordination.

2. The assembled underwater module according to claim 1, wherein said piping system is a rigid piping system.

3. The assembled underwater module according to claim 2, wherein said rigid piping system is a set of rigid pipes fitting inside one another, and configured to glide inside of one another, to adjust the height of said rigid piping system.

4. The assembled underwater module according to claim 1, wherein said piping system is a flexible piping system.

5. The assembled underwater module according to claim 1, wherein said flexible piping system is a flexible-plastic pipe workable under water pressure.

6. The assembled underwater module according to claim 5, wherein a winding mechanism is configured to adjust the length of said flexible-plastic pipe depending on the depth of said submerged booth under the water.

7. The assembled underwater module according to claim 1, wherein said floating buoy set is either a single donut-shape floating buoy, or a quantity of small buoys assembled uniformly into a set, with sufficient lifting force.

8. The assembled underwater module according to claim 1, wherein said assembled underwater module is configured to move in horizontal direction controlled by said observer using a propeller run by an electric motor, or by a submersible water pump, located in the weight block at the bottom of the underwater observation booth; said propeller can rotate 360° to choose the direction and at the same time to adjust the velocity of said assembled underwater module.

9. The assembled underwater module according to claim 1, wherein said assembled underwater module is configured to move in horizontal direction controlled by said observer using a pump being submerged in water, to move the module under the reaction force of the water jet, with the pump nozzle capable of 360° rotation, to choose direction and also adjust velocity of said assembled underwater module.

10. An assembled underwater module for an observer, wherein said observer is not under water pressure and is able to breathe directly atmospheric air being introduced into, and removed out of the submerged booth, by means of air conducting pipes; said assembled underwater module comprising:

a stabilizing means with sufficient loading force for keeping equilibrium and stabilization;

said stabilizing means being a station for introducing breathing air into said submerged booth, and also a platform to locate operating systems and supplemental devices including power generator, security devices and communication systems;

air supplying means for supplying breathing air and running electrical cables to said submerged booth with said observer inside;

weight means made with high density metal for increasing weight;

a cabin means for lodging said observer, operating equipment for said cabin means and said weight means;

a sensor means for proximity measurement and adjustment of distance of said submerged booth in vertical direction;

a first cover means for opening and closing said cabin means;

warning means located on said floating buoy set for signaling to warn vessel in vicinity;

a second cover means for covering the buoy floor containing on board devices;

wherein, said cabin means being transparent for said observer to look through said cabin means for easy observation;

said cabin means being in either a cylindrical shape with two half spherical top and bottom or a spherical shape; and said stabilizing means, said piping system, said ultrasonic sensors and said submerged booth are designed for synchronous operation and coordination.

11. The assembled underwater module according to claim 10, wherein said air supplying means is a rigid piping system.

12. The assembled underwater module according to claim 11, wherein said rigid piping system is a set of rigid pipes configured to glide inside one another to adjust the height of said rigid piping system.

13. The assembled underwater module according to claim 10, wherein said air supplying means is a flexible piping system.

14. The assembled underwater module according to claim 13, wherein said flexible piping system is a flexible-plastic pipe workable under water pressure.

15. The assembled underwater module according to claim 14, wherein a winding means is configured to adjust the length of said flexible-plastic pipe depending on the depth of said submerged booth under the water.

16. The assembled underwater module according to claim 10, wherein said stabilizing means is either a single donut-shape floating buoy or a quantity of small buoys uniformly assembled together with sufficient lifting force.

17. The assembled underwater module according to claim 10, wherein said assembled underwater module is configured to move in horizontal direction controlled by said observer using a propeller run by an electric motor or by a submersible water pump, located in the weight block at the bottom of said assembled underwater module; said propeller can be rotated 360° to choose the direction and at the same time to adjust the velocity of said assembled underwater module.

18. The assembled underwater module according to claim 10, wherein said assembled underwater module is configured to move in horizontal direction controlled by said observer using a pump being submerged in water, to move the module under the reaction force of the water jet, with the pump nozzle capable of 360° rotation, to choose direction and also adjust velocity of said assembled underwater module.

* * * * *